US007607266B2

(12) United States Patent
O'Hagin

(10) Patent No.: US 7,607,266 B2
(45) Date of Patent: Oct. 27, 2009

(54) SKYLIGHT APPARATUS FOR TILE ROOF

(76) Inventor: Harry T. O'Hagin, 119/26 Moo 2 Bann KHO, Pranakorn Sri Ayutthaya, Ayutthaya Province 13000 (TH)

( * ) Notice: Subject to any disclaimer, the term of this patent is extended or adjusted under 35 U.S.C. 154(b) by 217 days.

(21) Appl. No.: 11/526,557

(22) Filed: Sep. 25, 2006

(65) Prior Publication Data

US 2007/0068096 A1 Mar. 29, 2007

Related U.S. Application Data

(60) Provisional application No. 60/721,863, filed on Sep. 27, 2005.

(51) Int. Cl.
*E04D 13/03* (2006.01)

(52) U.S. Cl. ..... 52/200; 52/90.1; 52/18

(58) Field of Classification Search ..... 52/18, 52/90.1, 200

See application file for complete search history.

(56) References Cited

U.S. PATENT DOCUMENTS

| | | | | | |
|---|---|---|---|---|---|
| 1,740,749 | A | * | 12/1929 | Shuman | 52/200 |
| 1,792,704 | A | * | 2/1931 | Peverley | 52/200 |
| 3,983,675 | A | * | 10/1976 | Pearse et al. | 52/533 |
| 4,372,090 | A | * | 2/1983 | Shichijo | 52/536 |
| 4,730,426 | A | * | 3/1988 | Weisner et al. | 52/200 |
| 4,809,468 | A | * | 3/1989 | Bareiss | 52/200 |
| 5,596,848 | A | * | 1/1997 | Lynch | 52/200 |
| 5,613,333 | A | | 3/1997 | Witzig, Jr. | |
| 5,655,339 | A | * | 8/1997 | DeBlock et al. | 52/200 |
| 5,799,612 | A | | 9/1998 | Page | |
| 5,896,712 | A | | 4/1999 | Chao | |
| 5,896,713 | A | | 4/1999 | Chao et al. | |
| 5,953,869 | A | * | 9/1999 | Balfour et al. | 52/200 |
| RE36,496 | E | | 1/2000 | Sutton | |

(Continued)

FOREIGN PATENT DOCUMENTS

| | | | |
|---|---|---|---|
| GB | 2391024 | A | 1/2004 |
| WO | WO 02/25031 | A | 3/2002 |
| WO | WO 2004/042164 | A1 | 5/2004 |

OTHER PUBLICATIONS

PCT/US2006/037665 International Search Report and Written Opinion (Feb. 20, 2007) (11 pages).

*Primary Examiner*—Richard E Chilcot, Jr.
*Assistant Examiner*—Matthew J Smith
(74) *Attorney, Agent, or Firm*—Knobbe Martens Olson & Bear, LLP

(57) ABSTRACT

A building includes a tile roof including a plurality of courses of tiles and a roof-cover above which the tiles are positioned, a ceiling below the roof, and a skylight apparatus. Each tile engages adjacent tiles according to a repeating engagement structure. The skylight apparatus includes a main body in place of one or more of the tiles of the tile roof and engages adjacent tiles substantially according to the repeating engagement structure, at least one window, a tubular body below the main body and extending through an aperture in the roof-cover, a light conduit extending downward from below the tubular body and defining an inner passage, and a bottom translucent member at an opening in the ceiling and below a bottom end of the light conduit. Light is able to shine through the window, the inner passage, and the bottom translucent member into a room below the ceiling.

40 Claims, 12 Drawing Sheets

U.S. PATENT DOCUMENTS

| | | | | |
|---|---|---|---|---|
| 6,035,593 | A | 3/2000 | Chao et al. | |
| 6,039,390 | A | 3/2000 | Agrawal et al. | |
| 6,113,255 | A | 9/2000 | Shalit | |
| 6,219,977 | B1 | 4/2001 | Chao et al. | |
| 6,256,947 | B1 | 7/2001 | Grubb | |
| 6,321,493 | B1 | 11/2001 | Rillie et al. | |
| 6,363,667 | B2 | 4/2002 | O'Neill | |
| 6,363,668 | B2 | 4/2002 | Rillie et al. | |
| 6,412,238 | B2 | 7/2002 | Rillie et al. | |
| 6,415,563 | B2 | 7/2002 | Rillie et al. | |
| 6,438,803 | B2 | 8/2002 | Rillie et al. | |
| 6,493,128 | B1 | 12/2002 | Agrawal et al. | |
| 6,813,864 | B2 | 11/2004 | Landis | |
| 6,918,216 | B2 | 7/2005 | Hoy | |
| 7,040,061 | B2 * | 5/2006 | Rillie et al. | 52/200 |
| 7,168,211 | B2 * | 1/2007 | Prenn et al. | 52/200 |
| 2004/0057231 | A1 | 3/2004 | Skuse et al. | |
| 2005/0044808 | A1 | 3/2005 | Rillie | |
| 2005/0188629 | A1 | 9/2005 | Rillie et al. | |

* cited by examiner

SKYLIGHT APPARATUS FOR TILE ROOF

CROSS-REFERENCE TO RELATED APPLICATIONS

This application claims priority under 35 U.S.C. § 119(e) to U.S. Provisional Application Ser. No. 60/721,863, filed Sep. 27, 2005, entitled "Skylight Apparatus for Tile Roof," which is incorporated herein by reference in its entirety.

BACKGROUND

1. Field

The present invention relates to apparatuses and methods for illuminating buildings, and more specifically to skylights for illuminating buildings with tile roofs.

2. Description of the Related Art

Skylights can be used to illuminate the interior of buildings with light. Typically, a skylight includes a hemispherical, light-transmissive dome mounted on the roof of a building. To install a skylight on tiled roofs, the skylight is mounted and the surrounding tiles are cut to correspond to the shape of the skylight. Improper cutting and/or placement of the cut tiles can result in roof leakage. Accurate cutting may be challenging, for example when the tiles are curved and/or are made of clay or ceramic. Moreover, cutting may remove a portion of the tile designed to engage an adjacent tile, leading to poor or improper engagement.

SUMMARY OF CERTAIN INVENTIVE ASPECTS

In certain embodiments, a building comprises a tile roof, a ceiling below the roof, and a skylight apparatus. The tile roof includes a plurality of courses of tiles. Each tile engages adjacent tiles according to a repeating engagement structure. The tile roof includes a roof-cover above which the tiles are positioned. The skylight apparatus comprises a main body, at least one window, a tubular body, a light conduit, and a bottom translucent member. The main body is in place of one or more of the tiles of the tile roof and engages adjacent tiles substantially according to the repeating engagement structure. The tubular body is below the main body. The tubular body extends through an aperture in the roof-cover. The light conduit extends downward from below the tubular body. The light conduit defines an inner passage. The bottom translucent member is provided at an opening in the ceiling. The bottom translucent member is below a bottom end of the light conduit. Light is able to shine through the window, the inner passage, and the bottom translucent member into a room below the ceiling.

In certain embodiments, a skylight apparatus comprises a main body, at least one window in the main body, a tubular body extending downward below the window, and a sub-flashing. The main body is configured to take a place of one or more tiles of a tile roof and to engage adjacent tiles of the tile roof substantially according to a repeating engagement structure of the tiles. The sub-flashing includes a base and an opening in the base. The base is adapted to be secured to a roof-cover so that the opening fluidly communicates with an aperture in the roof-cover. The tubular body is configured to extend through the opening in the sub-flashing and through the aperture of the roof-cover. The window, tubular body, and sub-flashing are configured to be arranged so that light can shine through the window, tubular body, and sub-flashing opening.

In certain embodiments, a cover-member for a skylight apparatus comprises a main body configured to take a place of one or more substantially curved tiles of a tile roof and to engage adjacent tiles substantially according to a repeating engagement structure and at least one window formed within or secured to the main body.

In certain embodiments, a roof-protruding member for a skylight apparatus comprises a tubular body configured to extend through an aperture in a roof-cover and to be coupled to a light conduit and a flange extending from the tubular body. The flange is configured to be selectively attached and detached with respect to undersides of each of a plurality of differently shaped cover members emulating different tile shapes. The flange is configured to be attached to only one of the cover members at a time.

For purposes of summarizing the invention and the advantages achieved over the prior art, certain objects and advantages of the invention have been described above and as further described below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

These and other features, aspects, and advantages of the invention disclosed herein are described below with reference to the drawings of preferred embodiments, which are intended to illustrate and not to limit the invention.

Some of the figures are schematic and may include elements that are not drawn to scale with respect to one another.

DETAILED DESCRIPTION OF THE PREFERRED EMBODIMENTS

Although certain preferred embodiments and examples are disclosed below, it will be understood by those in the art that the invention extends beyond the specifically disclosed embodiments and/or uses of the invention and obvious modifications and equivalents thereof. Thus, it is intended that the scope of the invention herein disclosed should not be limited by the particular disclosed embodiments described below.

Figure 1:
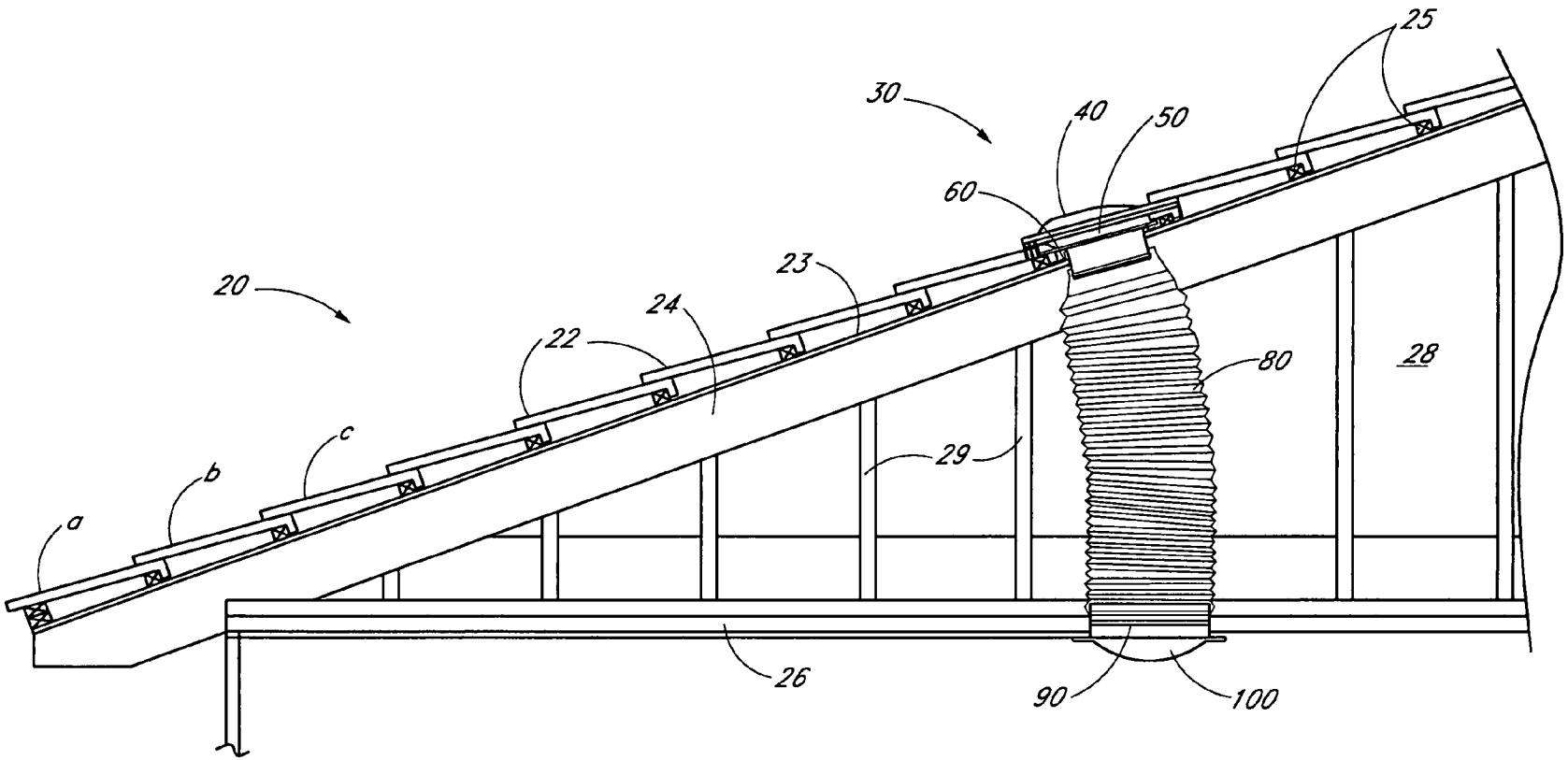
FIG. 1 is a side cutaway view of a roof and attic having a skylight apparatus according to one embodiment of the present invention.

FIG. 1 shows an upper portion of a building having a roof 20. The roof 20 comprises a plurality of courses (e.g., courses a, b, c . . . ) of tiles 22 arranged on a roof-cover 23 that is in turn supported by a plurality of rafters 24 and possibly purlins. The tiles 22 can be arranged according to conventional methods. For example, the each tile 22 may engage adjacent tiles 22 according to a repeating engagement structure. In particular, each tile 22 may interengage with the tiles 22 adjacent and to the sides, may overlap downslope one or more tiles 22, and may be overlapped by one or more tiles 22 upslope (e.g., as illustrated in FIG. 1). The illustrated roof 20 is formed above a substantially horizontal ceiling 26, which also defines a floor of an attic 28 between the roof 20 and the ceiling 26. Sidewalls of the attic 28 typically include vertical studs 29 spaced at equal intervals. Battens (or "spacers") 25 can be provided underneath the tiles 22, and preferably run parallel to an eave of the roof 20 and/or a ridge of the roof 20 (not shown). The spacing between the rafters 24 is typically based on architecture and/or building codes. The spacing between the battens 25 can be determined from the length of the particular tiles 22 being used, the amount of overlap between upslope and downslope tiles 22, etc.

The roof 20 includes a skylight apparatus 30 according to one embodiment of the present invention. In the illustrated embodiment, the skylight apparatus 30 comprises a cover-member 40, a roof-protruding member 50, a sub-flashing 60, a light conduit 80, a bottom fixture 90, and a bottom translucent member 100.

The cover-member 40 comprises a main body and at least one window formed within or secured to the main body. The main body is preferably adapted to be in place of one or more of the tiles 22 in one or more of the tile courses (e.g., by being shaped to emulate the shape of a tile 22). In certain embodiments, the cover-member 40 replaces one or more of the tiles 22 (i.e., by removing one or more originally placed tiles 22 and putting a cover-member 40 in place of the one or more removed tiles 22). In some embodiments, the cover-member 40 is originally placed along with the other tiles 22. In a preferred configuration, the cover-member 40 is in place of a single tile 22 of the roof 20, but the cover-member 40 can replace two, three, four, etc., of the tiles 22.

Figure 2C:
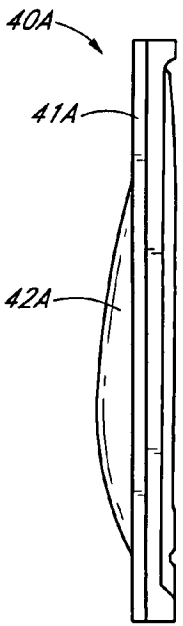
FIGS. 2A-2C are bottom, side, and end views, respectively, of a first embodiment of a cover-member of a skylight apparatus.
Figure 2A:
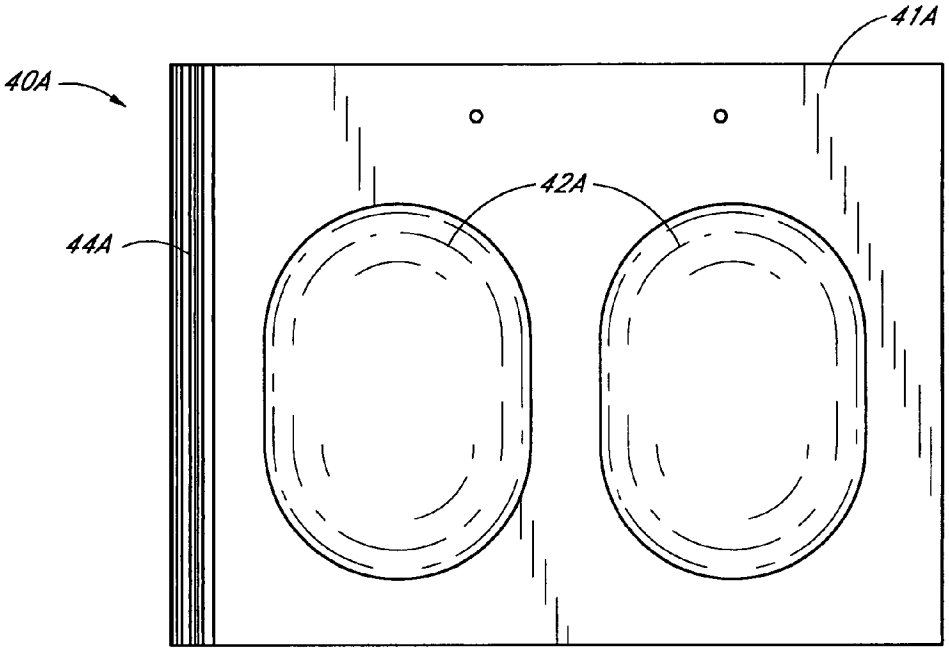
Figure 2B:
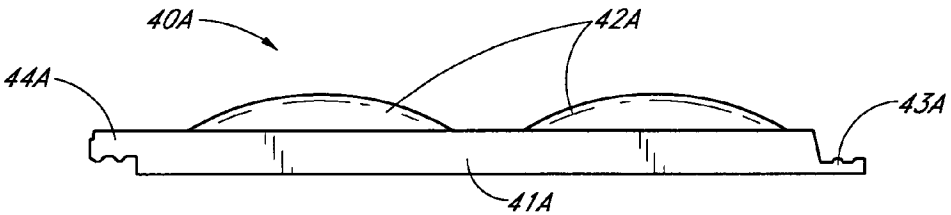

FIGS. 2A-2C illustrate a cover-member 40A according to a first embodiment, configured for use within a roof 20 having substantially flat tiles 22, for example as are known in the tile-roofing industry. The cover member 40A includes a generally flat main body 41A and a pair of at least partially translucent bubbles, domes, or windows 42A. Generally, one or more windows 42A can be provided in the main body 41A. In some embodiments, the main body 41A is formed of polycarbonate, but other materials are possible. The windows 42A can be formed of, e.g., polycarbonate or glass. The main body 41A includes a ledge 43A at one side and a ledge 44A at an opposite side to facilitate engagement of the cover-member 40A with adjacent tiles 22 or cover-members 40A, preferably substantially according to the repeating engagement structure of the tiles 22. The ledge 43A of the cover-member 40A is adapted to reside underneath and to engage ledge 44A of an adjacent tile 22 or cover-member 40A. The ledge 44A of the cover-member 40A is also adapted to reside above and to engage ledge 43A of an adjacent tile 22 or cover-member 40A.

Figure 3C:
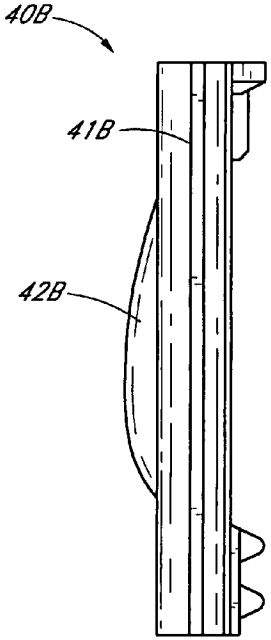
FIGS. 3A-3C are top, side, and end views, respectively, of a second embodiment of a cover-member of a skylight apparatus.
Figure 3A:
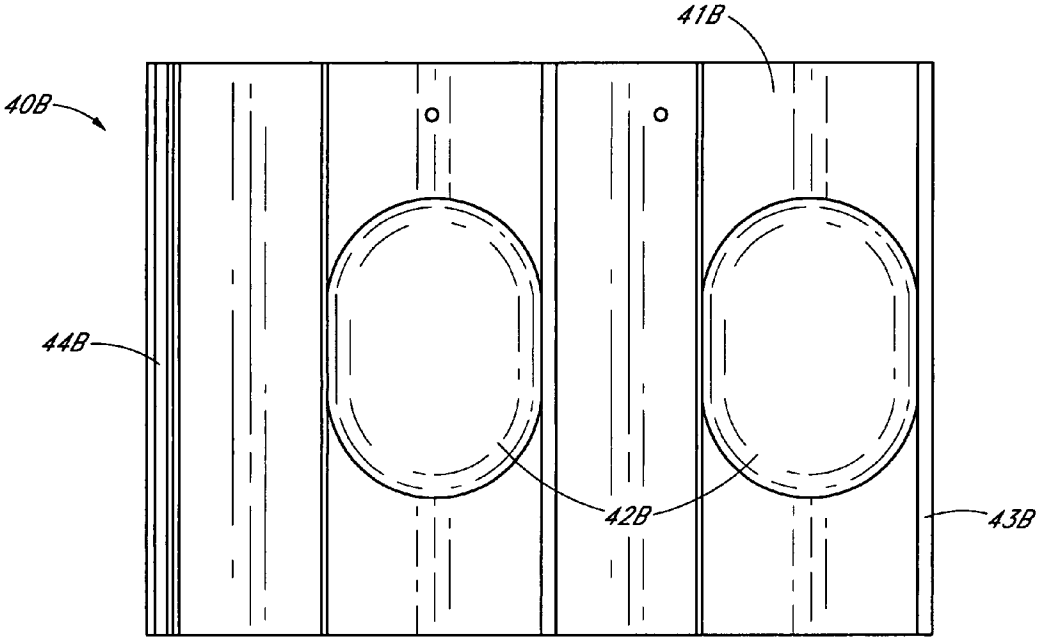
Figure 3B:
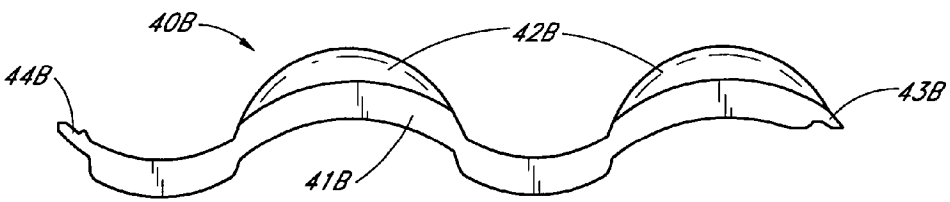

FIGS. 3A-3C illustrate a cover-member 40B according to a second embodiment, configured for use within a roof 20 having curved tiles 22, for example as are known in the tile-roofing industry. The illustrated cover-member 40B includes a curved main body 41B and a pair of at least partially translucent bubbles, domes, or windows 42B. Generally, one or more windows 42B can be provided in the main body 41B. In some embodiments, the main body 411B is formed of polycarbonate, but other materials are possible. The windows 42B can be formed of, e.g., polycarbonate or glass. The illustrated cover-member 40B is preferably configured for use within a roof 20 having "S-shaped" tiles, as are known in the art. Thus, the main body 41B includes two full double arches (readily apparent in FIG. 3B). The main body 41B includes a ledge 43B at one side and a ledge 44B at an opposite side to facilitate engagement of the cover-member 40B with adjacent tiles 22 or cover-members 40B, preferably substantially according to the repeating engagement structure of the tiles 22. The ledge 43B of the cover-member 40B is adapted to reside above and to engage ledge 44B of an adjacent tile 22 or cover-member 40B. The ledge 44B of the cover-member 40B is also adapted to reside underneath and to engage ledge 43B of an adjacent tile 22 or cover-member 40B.

Figure 4C:
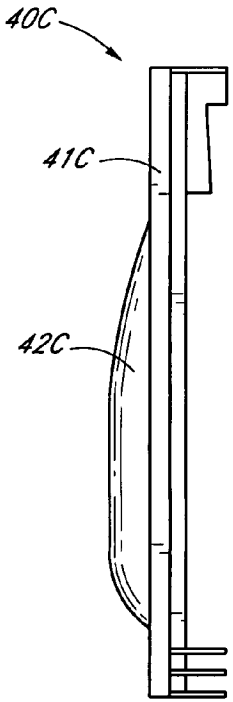
FIGS. 4A-4C are top, side, and end views, respectively, of a third embodiment of a cover-member of a skylight apparatus.
Figure 4A:
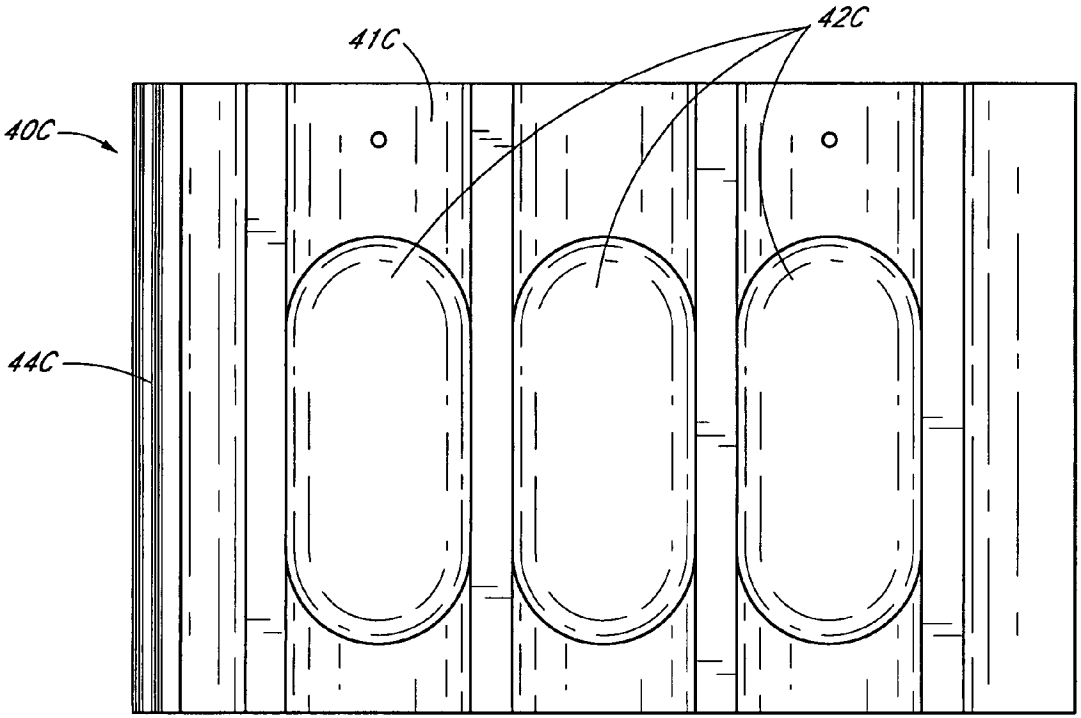
Figure 4B:
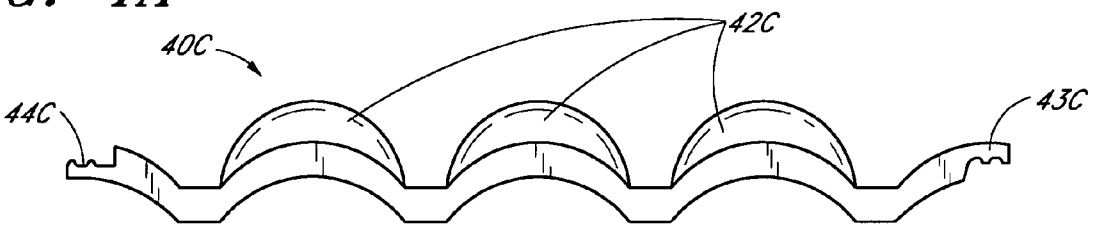

FIGS. 4A-4C illustrate a cover-member 40C according to a third embodiment, configured for use within a roof 20 having curved tiles 22, for example as are known in the tile roofing industry. The illustrated cover-member 40C includes a curved main body 41C and three at least partially translucent bubbles, domes, or windows 42C. Generally, one or more windows 42C can be provided in the main body 41C. In some embodiments, the main body 41C is formed of polycarbonate, but other materials are possible. The windows 42C can be formed of, e.g., polycarbonate or glass. The illustrated cover-member 40C is preferably configured for use within a roof having "M-shaped" tiles, as are known in the art. Thus, the main body 41C includes three full arches and two half-arches (readily apparent in FIG. 4B). The main body 41C includes a ledge 43C at one side and a ledge 44C at an opposite side to facilitate engagement of the cover-member 40C with adjacent tiles 22 or cover-members 40C, preferably substantially according to the repeating engagement structure of the tiles 22. The ledge 43C of the cover-member 40C is adapted to reside above and to engage ledge 44C of an adjacent tile 22 or cover-member 40C. The ledge 44C of the cover-member 40C is also adapted to reside underneath and to engage ledge 43C of an adjacent tile 22 or cover-member 40C.

In FIGS. 2-4, the ledges 43 and 44 preferably comprise a repeating engagement structure of the tiles 22. In other words, each tile 22 preferably includes ledges 43 and 44 for engaging adjacent tiles 22, as known in the art. Other types of repeating engagement structures for engaging adjacent tiles 22 or cover-members 40 are possible. Preferably, the cover-member 40 engages adjacent tiles or cover-members 40 substantially according to the repeating engagement structure of the tiles 22.

The embodiments illustrated in FIGS. 2-4 are for example purposes only. It will be understood that other shapes and configurations of cover-members 40 are possible. For example, the cover-members 40 may include a single window 42, two windows, 42, ten windows 42, etc. In some embodiments, the windows 42 are substantially flat. In certain embodiments, the windows 42 are curved and/or have a rise height such that they protrude from the tiles 22 enough to be seen visibly, to meet certain building codes, and the like.

Figure 5C:
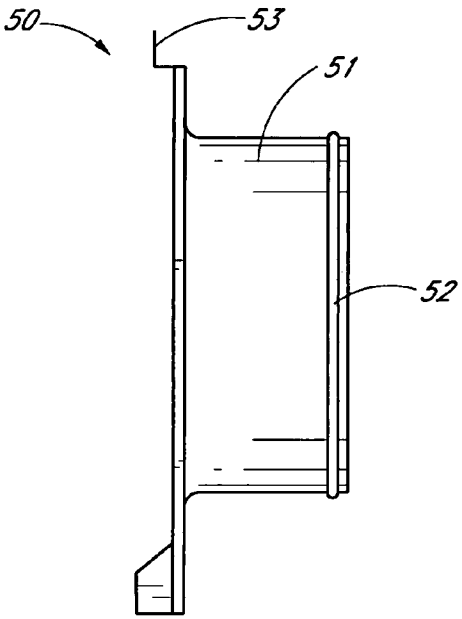
FIGS. 5A-5C are top, side, and end views, respectively, of an example embodiment of a roof-protruding member of a skylight apparatus.
Figure 5A:
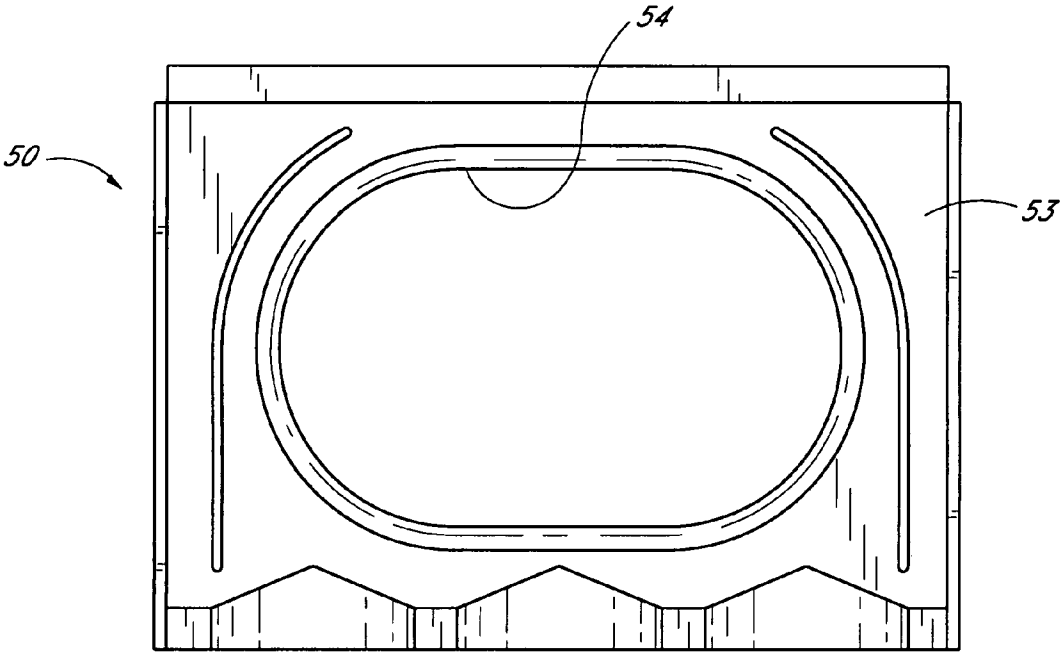
Figure 5B:
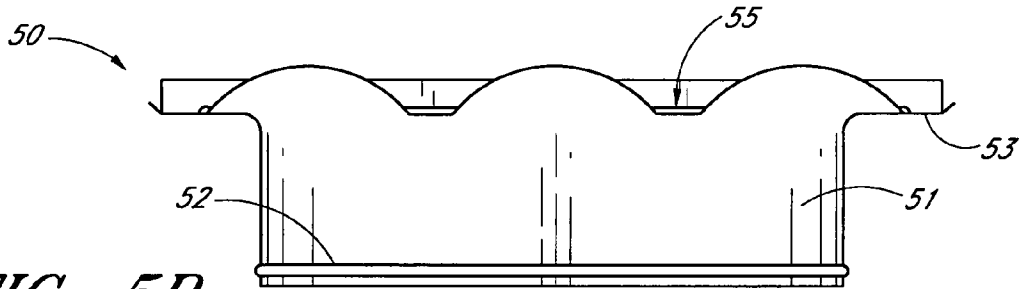
Figure 5D:
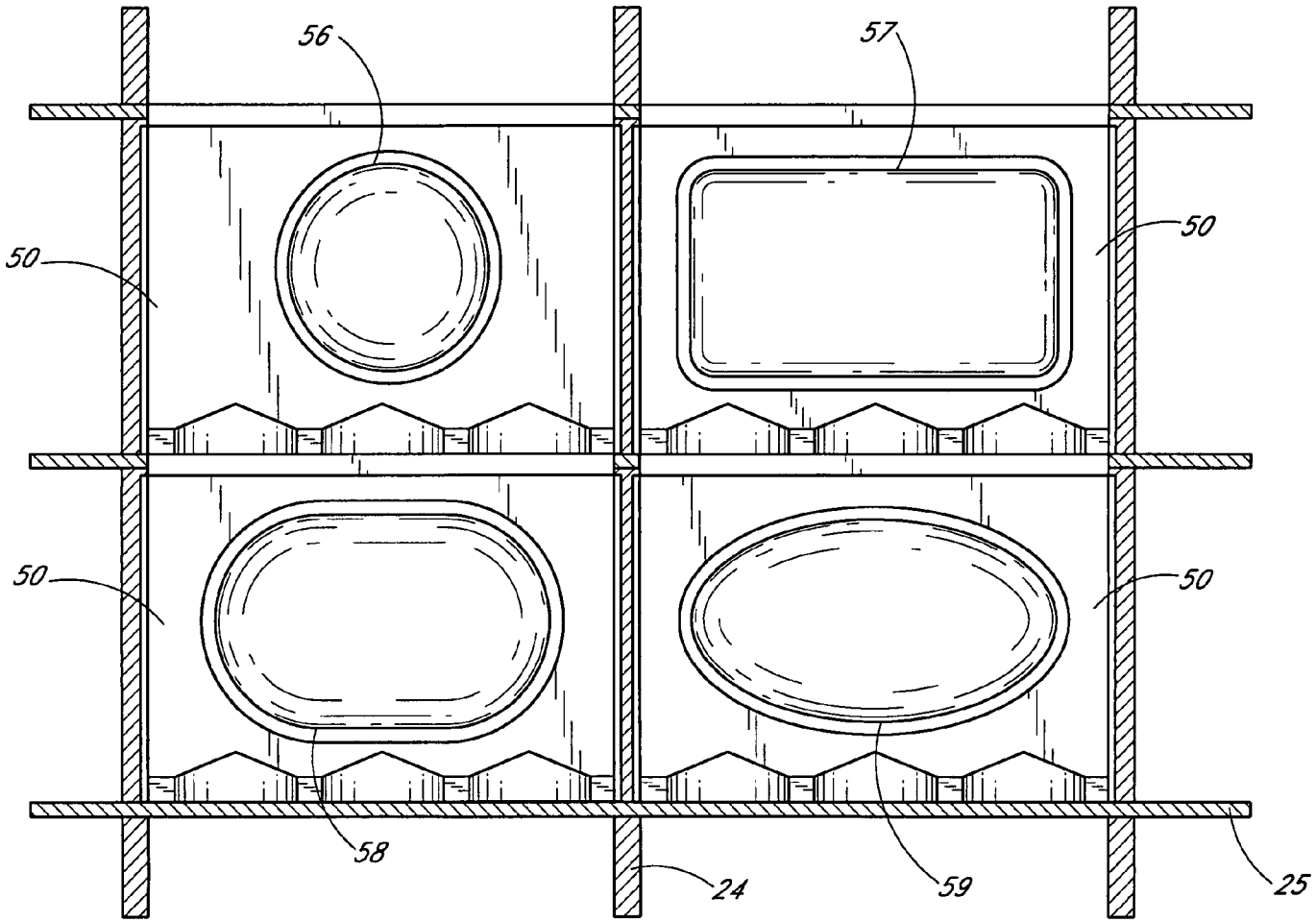
FIG. 5D is a top cutaway view of multiple embodiments of roof-protruding members disposed on a roof.
Figure 6A:
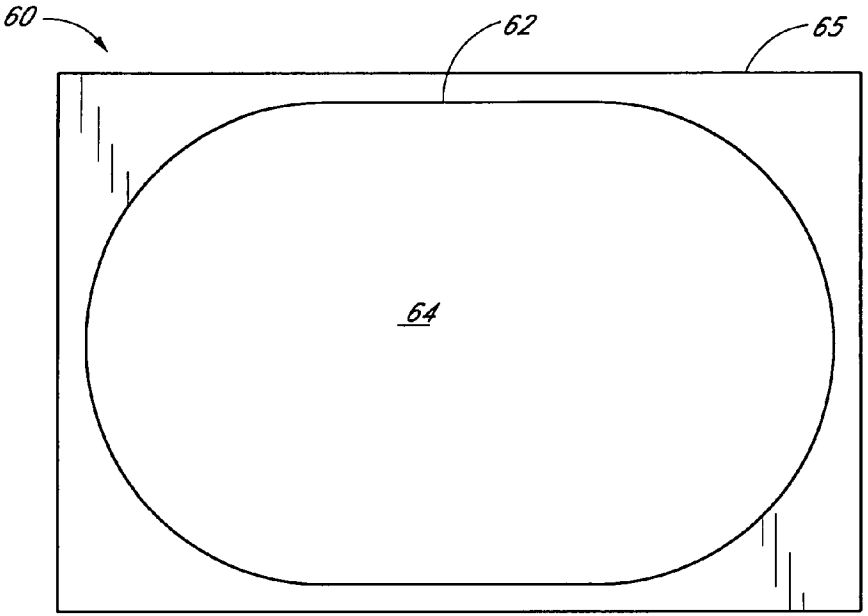
FIGS. 6A-6C are top, side, and end views, respectively, of an example embodiment of a sub-flashing of a skylight apparatus.
Figure 6B:
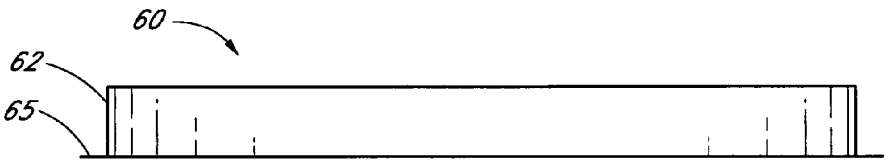
Figure 6C:
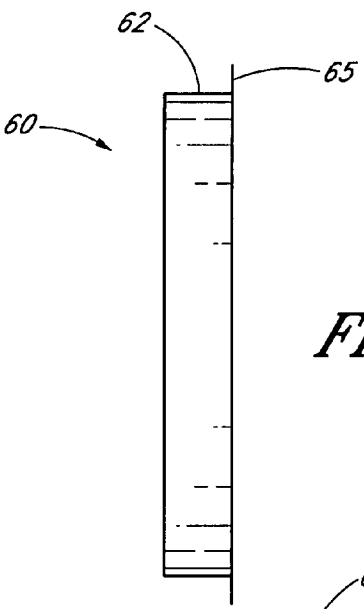
Figure 6D:
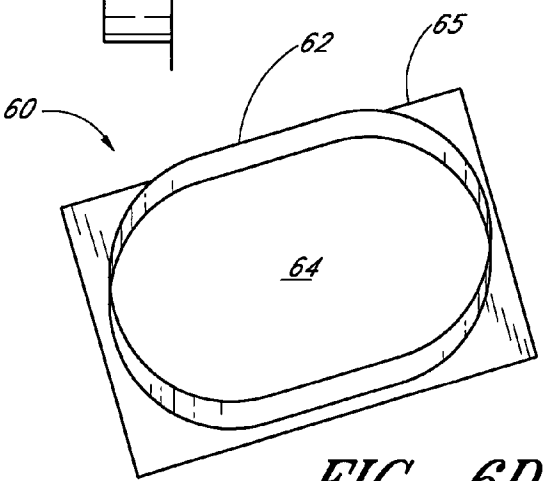
FIG. 6D is a top perspective view of the sub-flashing of FIGS. 6A-6C.

FIGS. 5A-5C illustrate an example embodiment of a roof-protruding member 50. The roof-protruding member 50 includes a preferably tubular body 51 having an annular lip 52 near a lower end and an outwardly extending flange 53 at an upper end. By "tubular," it is meant that the body 51 defines an inner conduit. The term "tubular" does not necessarily mean that the body 51 has a circular cross-section. Indeed, the cross-section of the illustrated body 51 is slightly elongated with rounded ends. FIG. 5D shows several possible shapes of the tubular body 51. In FIG. 5D, the illustrated roof-protruding members 50 include tubular bodies having cross-sections that are circular 56, rounded rectangular 57, elongated with rounded ends 58, and oval 59. Other shapes are also possible, preferably those shapes that maximize the cross-section of the tubular body 51 and still fit between adjacent battens 25 and adjacent rafters 24.

The roof-protruding member 50 may be configured such that the flange 53 rests on the roof-cover 23 or a batten 25, as discussed further below with respect to FIGS. 7A and 7B. In some embodiments, the roof-protruding member is selectively attachable and detachable with respect to the main body 41 of the cover-member 40. In certain embodiments, the roof-protruding member 50 is modular (i.e., the roof-protruding member 40 is configured to be used with a variety of different styles of cover-members 40). In certain alternative embodiments, the roof-protruding member 50 is configured to be used with a particular variety of cover-member 40. For example, the roof-protruding member 50 illustrated in FIGS. 5A-5C is particularly configured for use with the cover-member 40C illustrated in FIGS. 4A-4C. It will be appreciated that when the roof-protruding member 50 is configured to rest on either the roof-cover 23 or to rest on the batten 25 and an adjacent lower tile 22 that the roof-protruding member 50 may be either modular or configured to be used with a particular variety of cover-member 40.

The roof-protruding member 50 includes a horizontal structure 55 generally within or near the plane of the flange 53. This horizontal structure 55 is configured to permit light to shine downward into the inner passage of the tubular body 51. In some embodiments, the horizontal structure 55 includes an opening 54 or window through which the light shines. In some embodiments, a light-modifier is provided within the opening 54. For example, the light-modifier can comprise a light-diffuser configured to diffuse light (e.g., sunlight). The light-modifier can be configured to soften the light, change its color, or otherwise change its properties. The light-modifier can be a refractor or magnifier of light. The light-modifier, for example, can comprise a treated glass or polycarbonate. In one embodiment, the roof-protruding member 50 is formed of galvanized steel, but other materials are possible.

FIGS. 6A-6D illustrate an example embodiment of a sub-flashing 60. The sub-flashing 60 includes a base 65, a baffle 62, and an opening 64 inside the baffle 62. The tubular body 51 of the roof-protruding member 50 is configured to extend through the opening 64 in the sub-flashing 60, preferably with a close fit therebetween. Thus, the opening 64 of the sub-flashing 60, like the tubular body 51 of the roof-protruding member 50, is preferably configured to have a maximum cross-section and to still fit between adjacent battens 25 and rafters 24. The baffle 62 is configured to prevent leakage of water through the aperture in the roof-cover 23. In certain embodiments, the baffle 62 comprises a projection or wall extending upward from the base 65 and substantially surrounding the opening 64 in the sub-flashing 60. It will be appreciated that the baffle 62 may have any suitable shape to prevent leakage of water through the aperture in the roof cover 23 (e.g., V-shaped, U-shaped, etc.). In the illustrated embodiment, the baffle 62 defines the perimeter of the opening 64. However, it will be understood that the base 65 can extend radially inward of the baffle 62 such that the perimeter of the opening 64 is radially inward of the baffle 62. The base 65 is adapted to be secured to the roof-cover 23 so that the opening 64 fluidly communicates with an aperture in the roof cover.

Figure 7A:
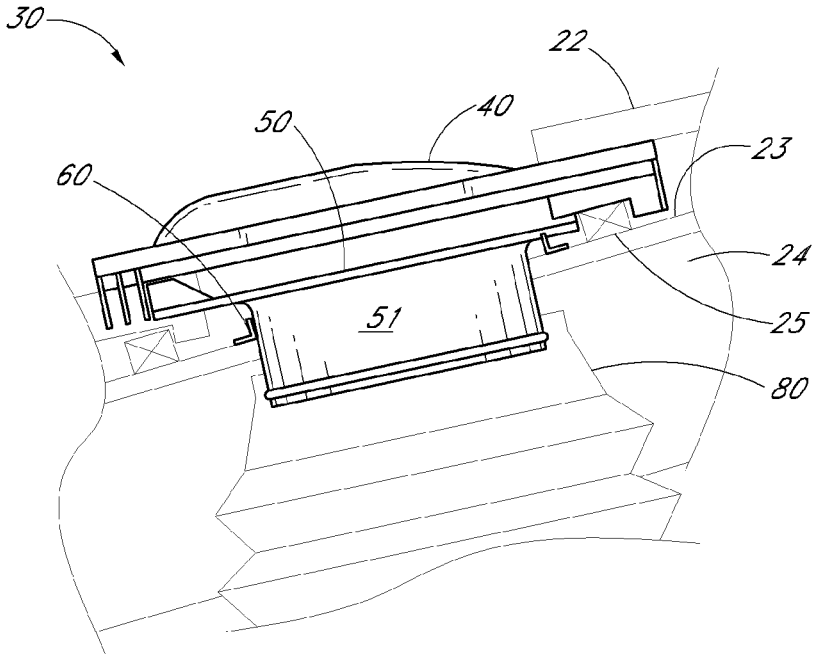
FIG. 7A is a side cutaway view of an example embodiment of a skylight apparatus installed in a roof.

FIG. 7A illustrates an embodiment of a tile roof 20 comprising a skylight apparatus 30. The skylight apparatus 30 comprises a cover-member 40 and a roof-protruding member 50. The flange 53 (FIGS. 5A-5C) of the roof-protruding member 50 is sized and shaped to rest on an edge of a batten 25 and an adjacent lower tile 22, such that the tubular body 51 of the roof-protruding member 50 extends downward through an aperture in the roof-cover 23. The flange 53 is attached to the underside of the main body 41 of the cover-member 40. The skylight apparatus 30 further comprises a sub-flashing 60, whose base 65 (FIGS. 6A-6D) is preferably secured to the roof-cover 23. The tubular body 51 of the roof-protruding member 50 also extends downward through an opening 64 (FIGS. 6A-6D) in the sub-flashing 60. The baffle 62 of the sub-flashing 60 is configured to prevent leakage of water between the battens 25 into the aperture in the roof-cover 23.

Figure 7B:
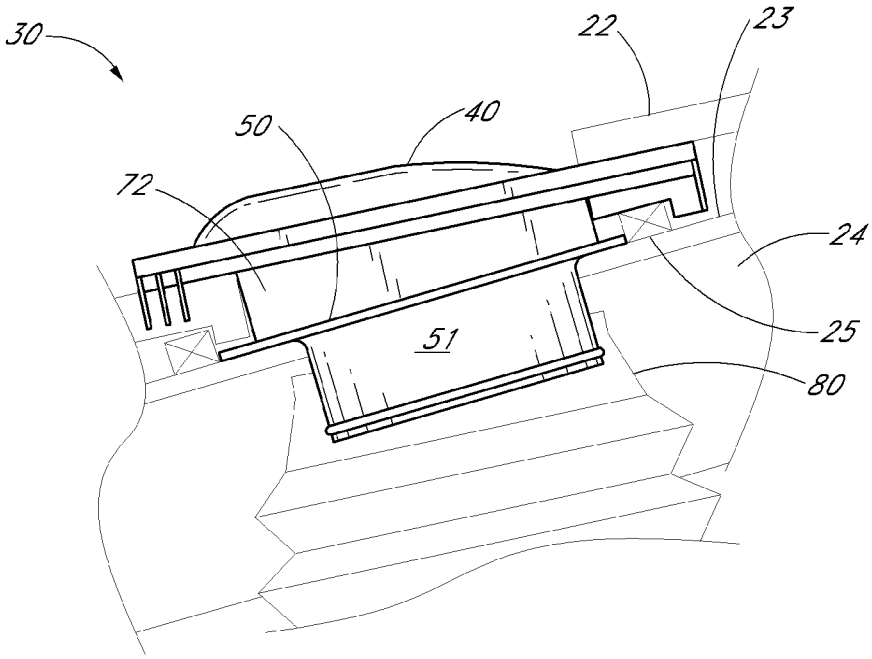
FIG. 7B is a side cutaway view of another example embodiment of a skylight apparatus installed in a roof.

FIG. 7B illustrates another embodiment of a tile roof 20 comprising a skylight apparatus 20. In the illustrated embodiment, the flange 53 of the roof-protruding member 50 is sized and shaped to rest on an edge of an aperture in the roof-cover 23, such that the tubular body 51 extends downward through the aperture in the roof-cover 23. In certain preferred embodiments, at least one of the cover member 40 and the roof-protruding member 50 comprises a wedge-shaped member to compensate for a difference between angular orientations of the tiles 22 and the roof-cover 40. In the illustrated embodiment, the roof-protruding member 50 includes a wedge-shaped portion 72. The wedge-shaped portion 72 is configured to extend between the cover-member 40 and the flange 53 of the roof-protruding member 50, whose flange 53 rests upon the roof-cover 23. The wedge-shaped portion 72 is configured to prevent leakage of water through an aperture in the roof-cover 23. The wedge-shaped member is preferably shaped to compensate for the difference in angular orientation between the roof-cover 23 and the tiles 22, if such a difference is present. If not, then there is usually no role for a wedge-shaped member.

Although FIGS. 1, 7A, and 7B illustrate a skylight apparatus 30 comprising a light conduit 80 and FIG. 1 illustrates a skylight apparatus further comprising a bottom fixture 90 and a bottom translucent member 100, it will be appreciated that certain components may be omitted (e.g., for roofs 20 having vaulted ceilings). As described with respect to FIG. 7B, the skylight apparatus 30 may not have a sub-flashing 60 in certain embodiments. Moreover, the cover-member 40 and the roof-protruding member 50 may be a single piece (i.e., having a main body and a tubular body formed integrally together) or a plurality of pieces.

Figure 8A:
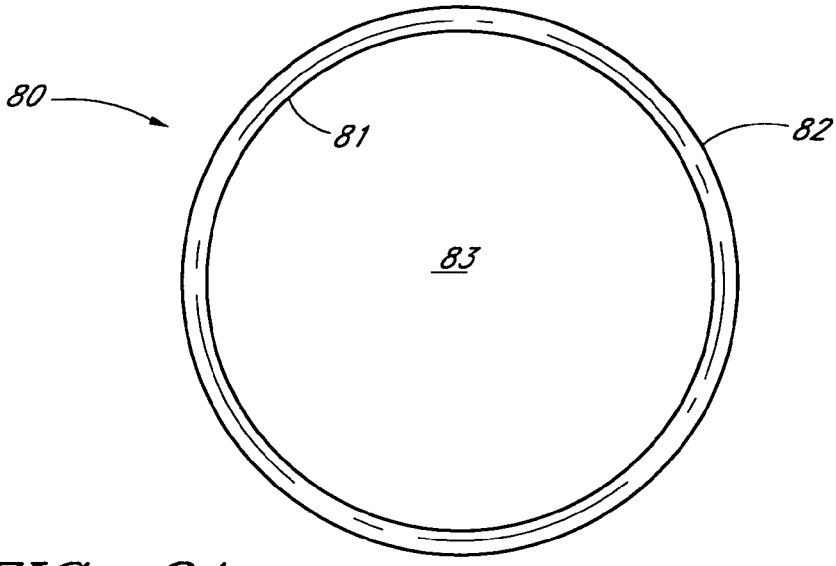
FIGS. 8A and 8B are top and side views, respectively, of an example embodiment of a flexible light conduit.
Figure 8B:
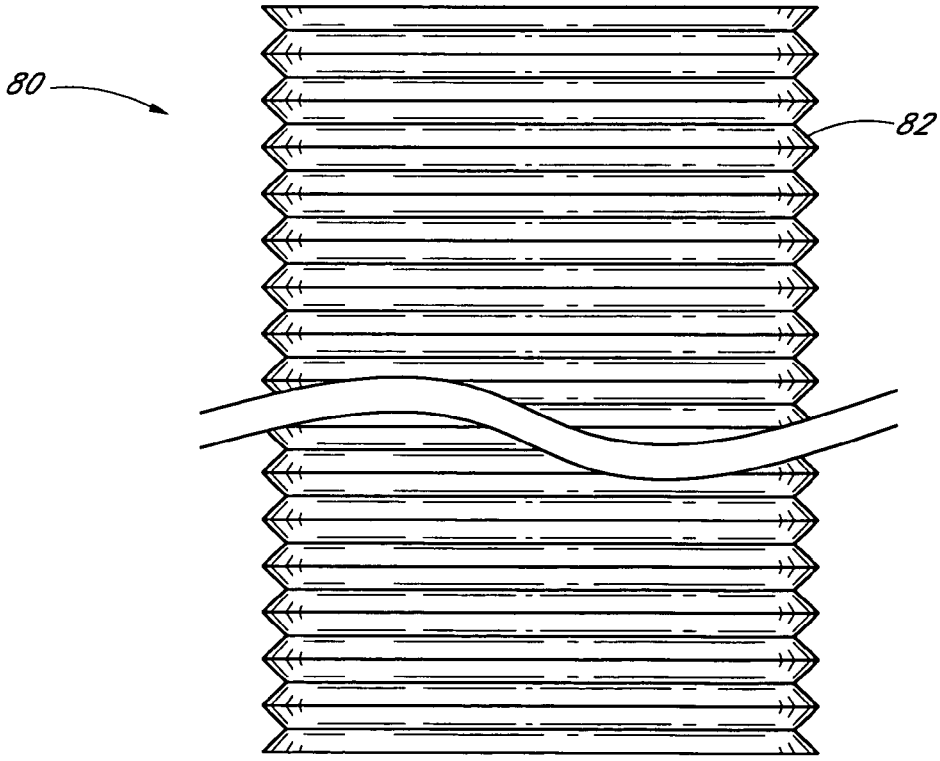

FIGS. 8A and 8B illustrate a light conduit 80 comprising a coil or helix 81 (e.g., a steel wire coil) surrounded by a sheath 82 of flexible material, preferably aluminum foil. The inner surface of the sheath 82 can be reflective, so that the conduit 80 more effectively transmits light through an inner passage 83 defined by the light conduit 80. The light conduit 80 is preferably flexible or adjustable to increase ease of installation and to accommodate different roof/ceiling geometries. However, rigid light conduits 80 are also within the scope of the invention. While the illustrated light conduit 80 is substantially cylindrical, alternative shapes are possible, such as conduits having cross-sections that are rectangular, diamond-shaped, oval, etc. In the illustrated embodiment, the upper end of the light conduit 80 slides over and surrounds the tubular body 51 of the roof-protruding member 50 (see FIGS. 5A-5C). The upper end of the light conduit 80 is preferably secured to the tubular body 51 by a securing strap, such as the strap 110 shown in FIGS. 11A and 11B (described below). Skilled artisans will appreciate that the light conduit 80 can be secured to the tubular body 51 by a variety of alternative methods, such as adhesives, screws, nut-and-bolt combinations, VELCRO™, and the like. The bottom end of the light conduit 80 is secured to a preferably tubular portion of the bottom fixture 90 (described more fully below). The bottom end of the light conduit 80 can be secured with a securing strap 110 or by alternative methods like adhesives, screws, nut-and-bolt combinations, VELCRO™, and the like.

Figure 9C:
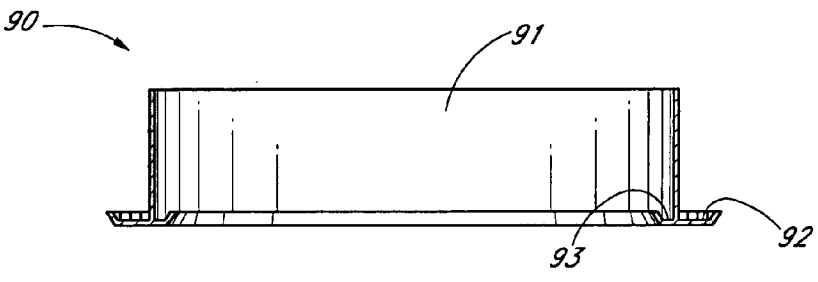
FIG. 9C is a cross-sectional view of the bottom fixture of FIGS. 9A-9B, taken along line 9C-9C of FIG. 9A.
Figure 9B:
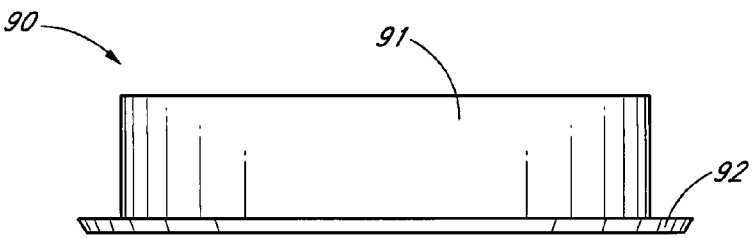
FIGS. 9A and 9B are top and side views, respectively, of an example embodiment of a bottom fixture.
Figure 9A:
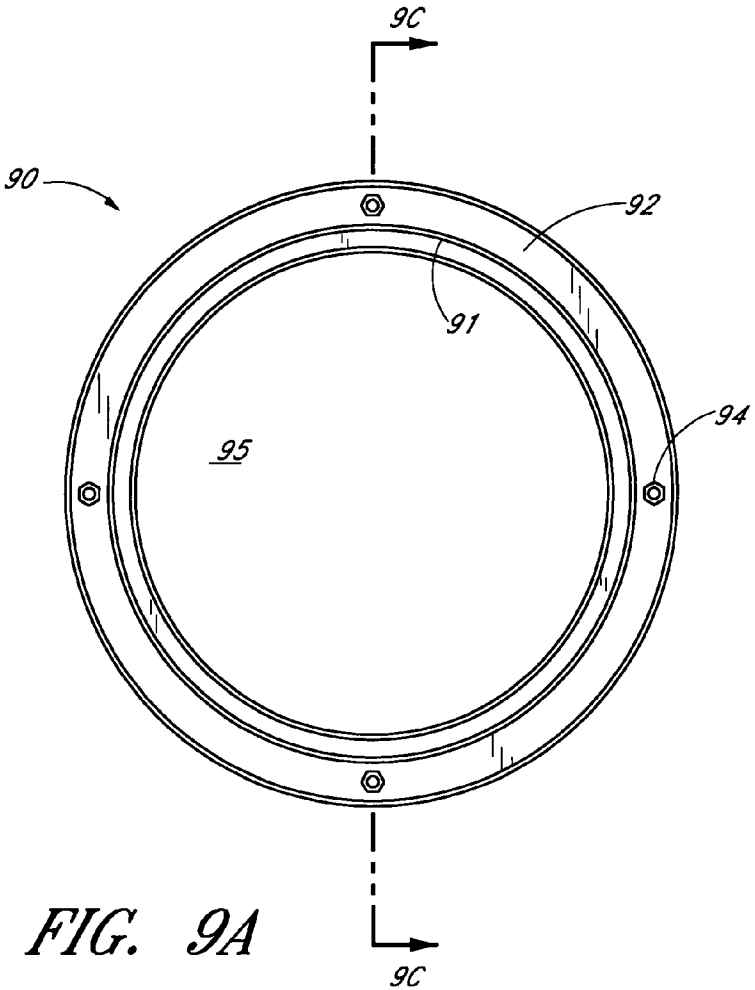

FIGS. 9A-9C illustrate a bottom fixture 90 including a tubular (but not necessarily circular) body 91, a flange 92 extending radially outward from the bottom edge of the body 91, and a shelf 93 extending radially inward from the bottom edge of the body 91. The flange 92 preferably comprises an annular flange, but other types of flanges (e.g., a discontinuous flange formed of several different flange portions) may be provided. The shelf 93 preferably comprises an annular shelf, but other types of shelves (e.g., a discontinuous shelf formed of several different shelf portions) may be provided. In a preferred arrangement, the bottom fixture 90 is secured to a lower surface of the ceiling 26 (see FIG. 1). The flange 92 preferably includes a plurality of apertures 94 for receiving bolts, screws, or nails for securing the fixture 90 to the ceiling 26. Other fasteners are also possible, including those that utilize the apertures 94 and those that do not (e.g., adhesives). The body 91 defines a central opening 95. The body 91, flange 92, and shelf 93 can be formed integrally, e.g., by molding. In one embodiment, the bottom fixture 90 is formed of polypropylene, but other materials are possible.

Figure 10C:
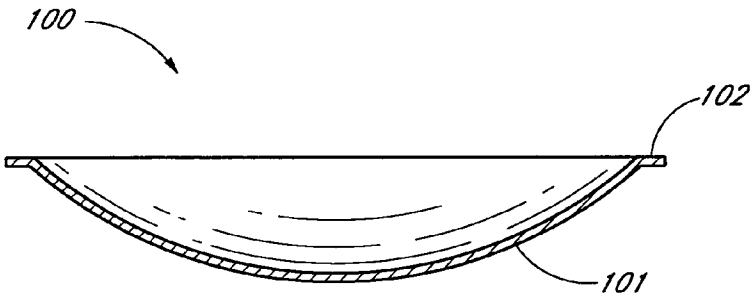
FIG. 10C is a cross-sectional view of the bottom translucent member of FIGS. 10A-10B, taken along line 10C-10C of FIG. 10A.
Figure 10B:
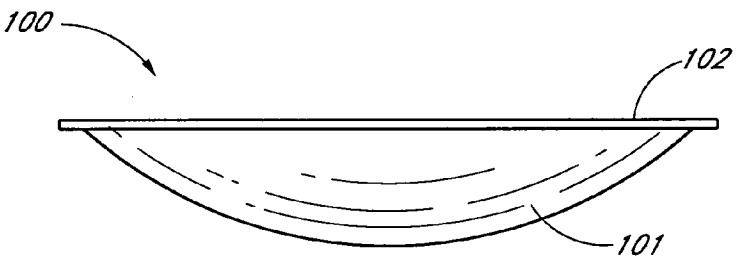
FIGS. 10A and 10B are top and side views, respectively, of an example embodiment of a bottom translucent member.
Figure 10A:
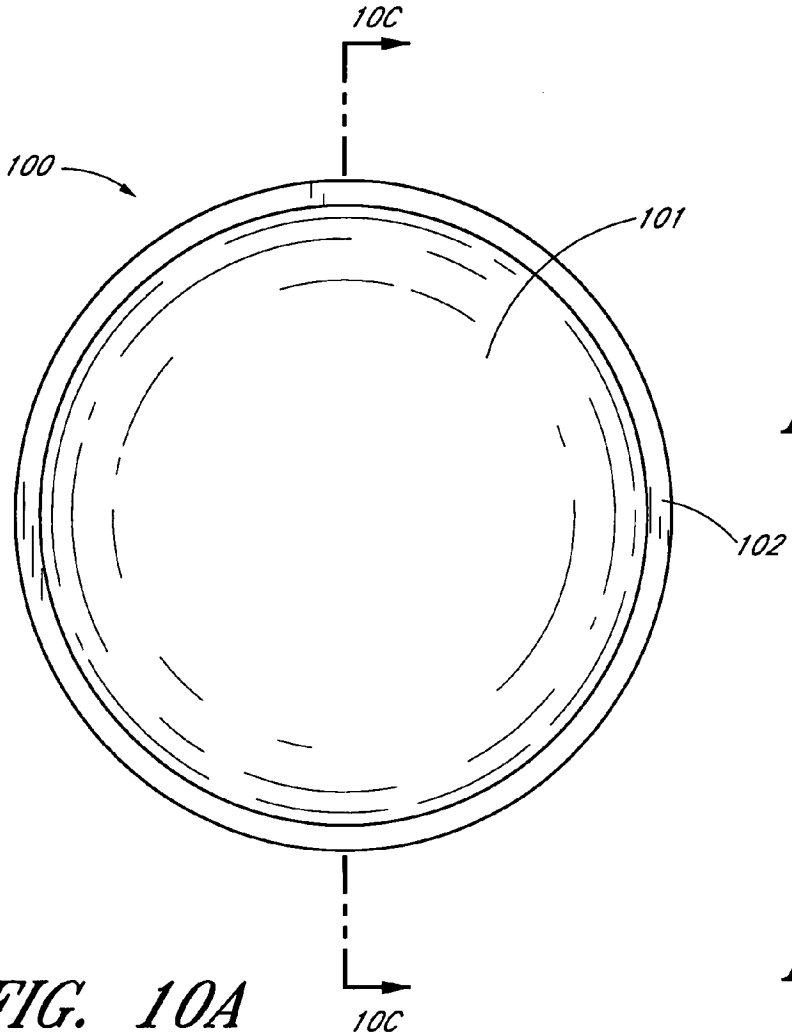

FIGS. 10A-10C show a bottom translucent member 100 according to one embodiment of the invention. The illustrated translucent member 100 includes a translucent body 101 that can be, e.g., bubble-shaped or dome-shaped. The body 101 is preferably formed of glass or polycarbonate. A flange 102 is preferably provided at an outer edge of the body 101. The flange 102 is preferably sized and shaped to rest on (and possibly be secured to) the shelf 93 of the bottom fixture 90 (see FIGS. 9A-9C). The flange 102 preferably comprises an annular flange, but other types of flanges (e.g., a discontinuous flange formed of several different flange portions) may be provided, giving due consideration to the goal of securely and stably resting on the shelf 93 of the bottom fixture 90. The body 101 and flange 102 can be formed integrally, e.g., by molding. In a preferred embodiment, the bottom translucent member 100 comprises a light-modifier, such as a light-diffuser. The bottom translucent member 100 can be configured to soften light passing therethrough, to change its color, or to modify other properties. The member 100 can be a refractor or magnifier of light. The bottom fixture 90 and bottom translucent member 100 are collectively referred to elsewhere herein as a "bottom apparatus."

Figure 11A:
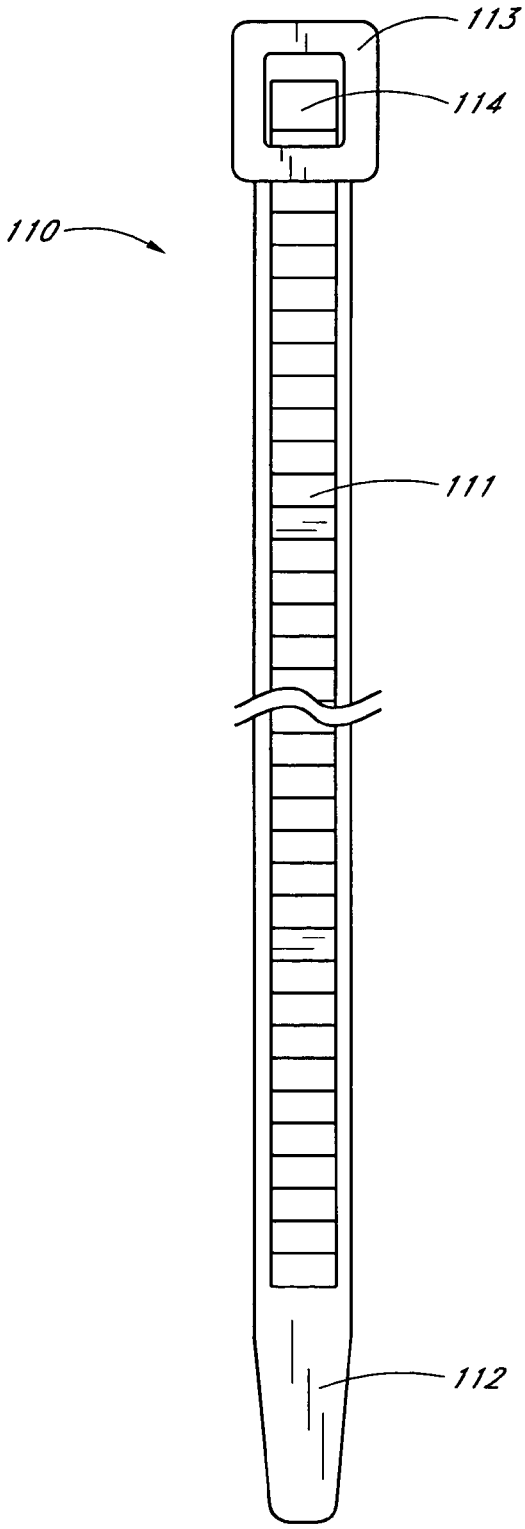
FIGS. 11A and 11B are top and side views, respectively, of an example embodiment of a securing strap.
Figure 11B:
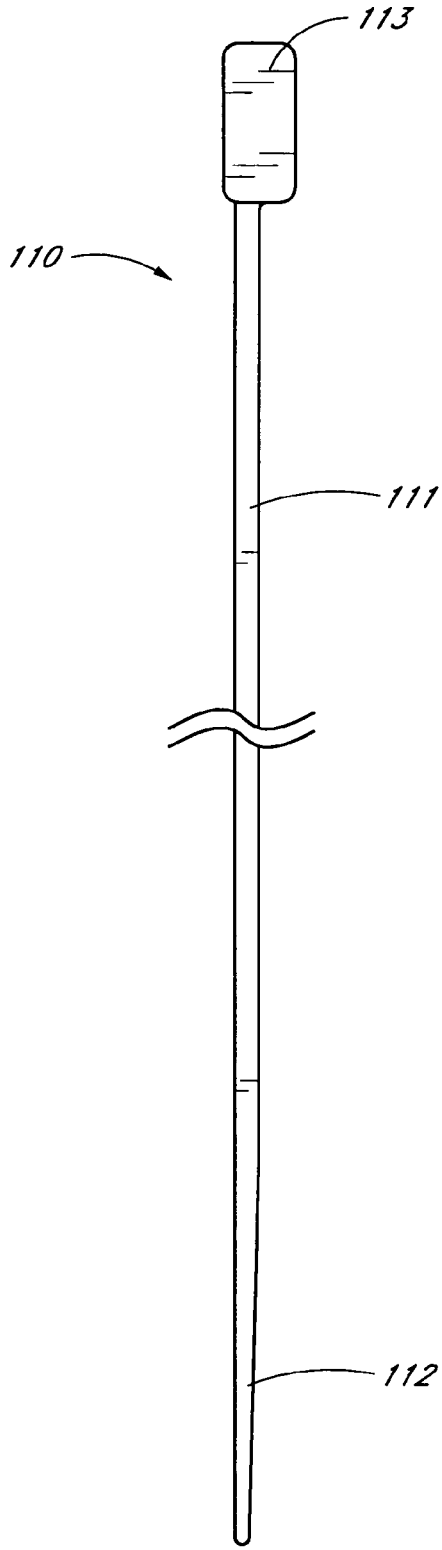

FIGS. 11A and 11B show one embodiment of a securing strap 110 for securing the ends of the flexible light conduit 80 to the roof-protruding member 50 and the bottom fixture 90. The illustrated strap 110 comprises a body 111, a first end 112, and a second end 113 having a buckle 114. In use, the body 111 is wrapped around an item to be tied or secured (e.g., the light conduit 80), the first end 112 is inserted into the buckle 114, and the first end 112 is pulled until the strap 110 tightens. The body 111 preferably includes a roughened surface to help prevent loosening. The illustrated strap 110 configuration is well known.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications thereof. In addition, while several variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. It should be understood that various features and aspects of the disclosed embodiments can be combined with, or substituted for, one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A skylight apparatus comprising:

a main body configured to take a place of one or more tiles of a tile roof and to engage adjacent tiles of the tile roof substantially according to a repeating engagement structure of the tiles;

a first window formed within or secured to the main body;

a roof-protruding member configured to be installed below the main body, the roof-protruding member comprising a tubular body configured to extend through an aperture in a roof-cover, at least one of the main body and the roof-protruding member comprising a substantially wedge-shaped member configured to compensate for a difference between angular orientations of a roof-cover and an installed main body oriented substantially parallel to tiles of a tile roof, wherein the main body substantially matches the shape of substantially "S-shaped" tiles.

2. The skylight apparatus of claim 1, wherein the window is curved.

3. The skylight apparatus of claim 2, wherein the window has a height above the main body.

4. The skylight apparatus of claim 1, wherein the repeating engagement structure comprises interengaging ledges.

5. The skylight apparatus of claim 1, wherein the repeating engagement structure comprises a downslope portion of a first tile of the tile roof overlapping an upslope portion of a second tile of the tile roof.

6. The skylight apparatus of claim 1, wherein the roof-protruding member is adapted to be selectively attached and detached with respect to an underside of the main body.

7. The skylight apparatus of claim 1, further comprising a sub-flashing including a base and an opening in the base, the base adapted to be secured to a roof-cover so that the opening fluidly communicates with an aperture in the roof-cover, the tubular body configured to extend through the opening in the sub-flashing and through the aperture of the roof-cover, wherein the first window, the tubular body, and the sub-flashing are configured to be arranged so that light can shine through the first window, the tubular body, and the sub-flashing opening.

8. The skylight apparatus of claim 7, wherein the sub-flashing includes an upstanding baffle wall substantially surrounding the opening in the sub-flashing, the baffle wall configured to prevent leakage of water through the aperture in the roof-cover.

9. The skylight apparatus of claim 1, further comprising:

a light conduit having an upper end configured to engage the tubular body and to extend downward therefrom, the light conduit defining an inner passage; and a bottom apparatus configured to be secured within an opening of a ceiling, the bottom apparatus configured to engage a bottom end of the light conduit, the bottom apparatus including a translucent member;

wherein the first window, the tubular body, the light conduit, and the bottom apparatus are configured to be arranged so that light can shine through the first window, the tubular body, the inner passage, and the translucent member.

10. The skylight apparatus of claim 9, wherein at least one of the window and the translucent member comprises at least one of a light-diffuser and a light-softener.

11. The skylight apparatus of claim 9, wherein at least one of the window and the translucent member is configured to modify a color of light shining therethrough.

12. The skylight apparatus of claim 9, wherein the bottom apparatus comprises:

a tubular body configured to extend through an opening of a ceiling, the light conduit being secured to the tubular body of the bottom apparatus;

a flange extending radially outward from the tubular body of the bottom apparatus, the flange of the bottom apparatus configured to be secured to a ceiling; and a shelf extending radially inward from the tubular body of the bottom apparatus, the shelf configured to support an outer portion of the translucent member.

13. The skylight apparatus of claim 1, wherein the wedge-shaped member is configured to prevent leakage of water through an aperture in a roof-cover.

14. The skylight apparatus of claim 1, wherein the roof-protruding member comprises a second window.

15. The skylight apparatus of claim 14, wherein the second window comprises at least one of a light-diffuser, a light-softener, and a light-color modifier.

16. The skylight apparatus of claim 14, wherein the second window comprises glass.

17. The skylight apparatus of claim 1, wherein the first window comprises polycarbonate.

18. The skylight apparatus of claim 1, wherein the tubular body has a cross-section that is oval.

19. The skylight apparatus of claim 1, wherein the tubular body has a cross-section that is elongated with rounded ends.

20. The skylight apparatus of claim 1, wherein the tubular body has a cross-section that is rectangular with rounded corners.

21. A skylight apparatus comprising:

a main body configured to take a place of one or more tiles of a tile roof and to engage adjacent tiles of the tile roof substantially according to a repeating engagement structure of the tiles;

a first window formed within or secured to the main body;

a roof-protruding member configured to be installed below the main body, the roof-protruding member comprising a tubular body configured to extend through an aperture in a roof-cover, at least one of the main body and the roof-protruding member comprising a substantially wedge-shaped member configured to compensate for a difference between angular orientations of a roof-cover and an installed main body oriented substantially parallel to tiles of a tile roof, wherein the main body substantially matches the shape of substantially "M-shaped" tiles.

22. The skylight apparatus of claim 21, wherein the window is curved.

23. The skylight apparatus of claim 21, wherein the window has a height above the main body.

24. The skylight apparatus of claim 21, wherein the repeating engagement structure comprises interengaging ledges.

25. The skylight apparatus of claim 21, wherein the repeating engagement structure comprises a downslope portion of a first tile of the tile roof overlapping an upslope portion of a second tile of the tile roof.

26. The skylight apparatus of claim 21, wherein the roof-protruding member is adapted to be selectively attached and detached with respect to an underside of the main body.

27. The skylight apparatus of claim 21, further comprising:

a light conduit having an upper end configured to engage the tubular body and to extend downward therefrom, the light conduit defining an inner passage; and a bottom apparatus configured to be secured within an opening of a ceiling, the bottom apparatus configured to engage a bottom end of the light conduit, the bottom apparatus including a translucent member;

wherein the first window, the tubular body, the light conduit, and the bottom apparatus are configured to be arranged so that light can shine through the first window, the tubular body, the inner passage, and the translucent member.

28. The skylight apparatus of claim 27, wherein at least one of the window and the translucent member comprises at least one of a light-diffuser and a light-softener.

29. The skylight apparatus of claim 27, wherein at least one of the window and the translucent member is configured to modify a color of light shining therethrough.

30. The skylight apparatus of claim 27, wherein the bottom apparatus comprises:

a tubular body configured to extend through an opening of a ceiling, the light conduit being secured to the tubular body of the bottom apparatus;

a flange extending radially outward from the tubular body of the bottom apparatus, the flange of the bottom apparatus configured to be secured to a ceiling; and a shelf extending radially inward from the tubular body of the bottom apparatus, the shelf configured to support an outer portion of the translucent member.

31. The skylight apparatus of claim 21, wherein the wedge-shaped member is configured to prevent leakage of water through an aperture in a roof-cover.

32. The skylight apparatus of claim 21, wherein the roof-protruding member comprises a second window.

33. The skylight apparatus of claim 32, wherein the second window comprises at least one of a light-diffuser, a light-softener, and a light-color modifier.

34. The skylight apparatus of claim 32, wherein the second window comprises glass.

35. The skylight apparatus of claim 21, wherein the first window comprises polycarbonate.

36. The skylight apparatus of claim 21, further comprising a sub-flashing including a base and an opening in the base, the base adapted to be secured to a roof-cover so that the opening fluidly communicates with an aperture in the roof-cover, the tubular body configured to extend through the opening in the sub-flashing and through the aperture of the roof-cover, wherein the first window, the tubular body, and the sub-flashing are configured to be arranged so that light can shine through the first window, the tubular body, and the sub-flashing opening.

37. The skylight apparatus of claim 36, wherein the sub-flashing includes an upstanding baffle wall substantially surrounding the opening in the sub-flashing, the baffle wall configured to prevent leakage of water through the aperture in the roof-cover.

38. The skylight apparatus of claim 21, wherein the tubular body has a cross-section that is oval.

39. The skylight apparatus of claim 21, wherein the tubular body has a cross-section that is elongated with rounded ends.

40. The skylight apparatus of claim 21, wherein the tubular body has a cross-section that is rectangular with rounded corners.

* * * * *

UNITED STATES PATENT AND TRADEMARK OFFICE

CERTIFICATE OF CORRECTION

PATENT NO. : 7,607,266 B2
APPLICATION NO. : 11/526557
DATED : October 27, 2009
INVENTOR(S) : Harry T. O'Hagin It is certified that error appears in the above-identified patent and that said Letters Patent is hereby corrected as shown below:

At Column 4, Line 26, change "411B" to --41B--.

At Column 10, Line 21, in Claim 23, change "claim 21," to --claim 22,--.

Signed and Sealed this

Thirtieth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,607,266 B2
APPLICATION NO. : 11/526557
DATED : October 27, 2009
INVENTOR(S) : Harry T. O'Hagin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 249 days.

Signed and Sealed this

Twelfth Day of October, 2010

David J. Kappos

David J. Kappos
*Director of the United States Patent and Trademark Office*